US012320357B2

(12) United States Patent
Daussin et al.

(10) Patent No.: US 12,320,357 B2
(45) Date of Patent: Jun. 3, 2025

(54) COUNTERWEIGHT FOR A SCROLL COMPRESSOR

(71) Applicant: Danfoss Commercial Compressors, Trevoux (FR)

(72) Inventors: Arnaud Daussin, Nordborg (DK); David Genevois, Nordborg (DK); Remi Bou Dargham, Nordborg (DK)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 0 days.

(21) Appl. No.: 18/249,277

(22) PCT Filed: Nov. 24, 2021

(86) PCT No.: PCT/EP2021/082832
§ 371 (c)(1),
(2) Date: Apr. 17, 2023

(87) PCT Pub. No.: WO2022/112336
PCT Pub. Date: Jun. 2, 2022

(65) Prior Publication Data

US 2023/0407869 A1 Dec. 21, 2023

(30) Foreign Application Priority Data

Nov. 25, 2020 (FR) ..... 2012120

(51) Int. Cl.
*F04C 18/02* (2006.01)
*F04C 23/00* (2006.01)
(Continued)

(52) U.S. Cl.
CPC ..... *F04C 29/0021* (2013.01); *F04C 18/0215* (2013.01); *F04C 23/008* (2013.01);
(Continued)

(58) Field of Classification Search
CPC .... F04C 18/0215; F04C 23/008; F04C 29/02; F04C 29/0021; F04C 2230/00; F04C 2230/20; F04C 2240/807
See application file for complete search history.

(56) References Cited

U.S. PATENT DOCUMENTS 7,390,179 B2 6/2008 Reinhart et al.
2015/0078945 A1* 3/2015 Su ..... F04C 18/0215 418/55.1

(Continued)

FOREIGN PATENT DOCUMENTS

CN 104302919 A 1/2015
JP 10281083 A * 10/1998 ..... F04C 18/0215
WO 2013/152705 A1 10/2013

OTHER PUBLICATIONS

Applied Materials Today 7 (2017) 120-133—Jian-Yuan Lee, Jia An, Chee Kai Chua—Fundamentals and applications of 3D printing for novel materials -Feb. 9, 2017 (Year: 2017).*

(Continued)

*Primary Examiner* — Theresa Trieu
(74) *Attorney, Agent, or Firm* — McCormick, Paulding & Huber PLLC

(57) ABSTRACT

The counterweight (26) is manufactured by an additive manufacturing process and includes a mounting portion (28) having a first density and a mass portion (29) having a second density, the mass portion (29) being formed radially outward of the mounting portion (28), wherein the first density of the mounting portion (28) and the second density of the mass portion (29) are different from each other, and wherein the mass portion (29) includes at least a first segment (29.1) having a first segment density and a second segment (29.2) having a second segment density which is different from the first segment density.

21 Claims, 4 Drawing Sheets

(51) Int. Cl.
*F04C 29/00* (2006.01)
*F04C 29/02* (2006.01)

(52) U.S. Cl.
CPC ..... *F04C 29/02* (2013.01); *F04C 2230/20* (2013.01); *F04C 2240/807* (2013.01)

(56) References Cited

U.S. PATENT DOCUMENTS

| | | | | |
|---|---|---|---|---|
| 2016/0237825 | A1 | 8/2016 | Himes | |
| 2017/0058900 | A1* | 3/2017 | Park | F04C 18/0215 |
| 2017/0184108 | A1* | 6/2017 | Scancarello | F04C 18/0215 |
| 2019/0063436 | A1 | 2/2019 | Takamura et al. | |
| 2019/0154037 | A1 | 5/2019 | Doepker | |
| 2019/0338779 | A1 | 11/2019 | Shaffer et al. | |

OTHER PUBLICATIONS

Composites Part B -143 (2018) 172-196—Ngo, Tuan D.; Kashani, Alireza; Imbaizano, Gabriele; Nguyen, Kate T. Q .; Hut, David—Additive manufacturing (3D printing): A review of materials, methods, applications and challenges.—Feb. 13, 2018.—(Year: 2018).*

International Search Report mailed on Mar. 10, 2022, in connection with corresponding International Application No. PCT/EP2021/082832; 5 pages.

Summary English translation and Chinese Office Action, in connection with corresponding Chinese Pat. App. No. 202180078124.X, dated Mar. 20, 2025.

* cited by examiner

[Fig 1]
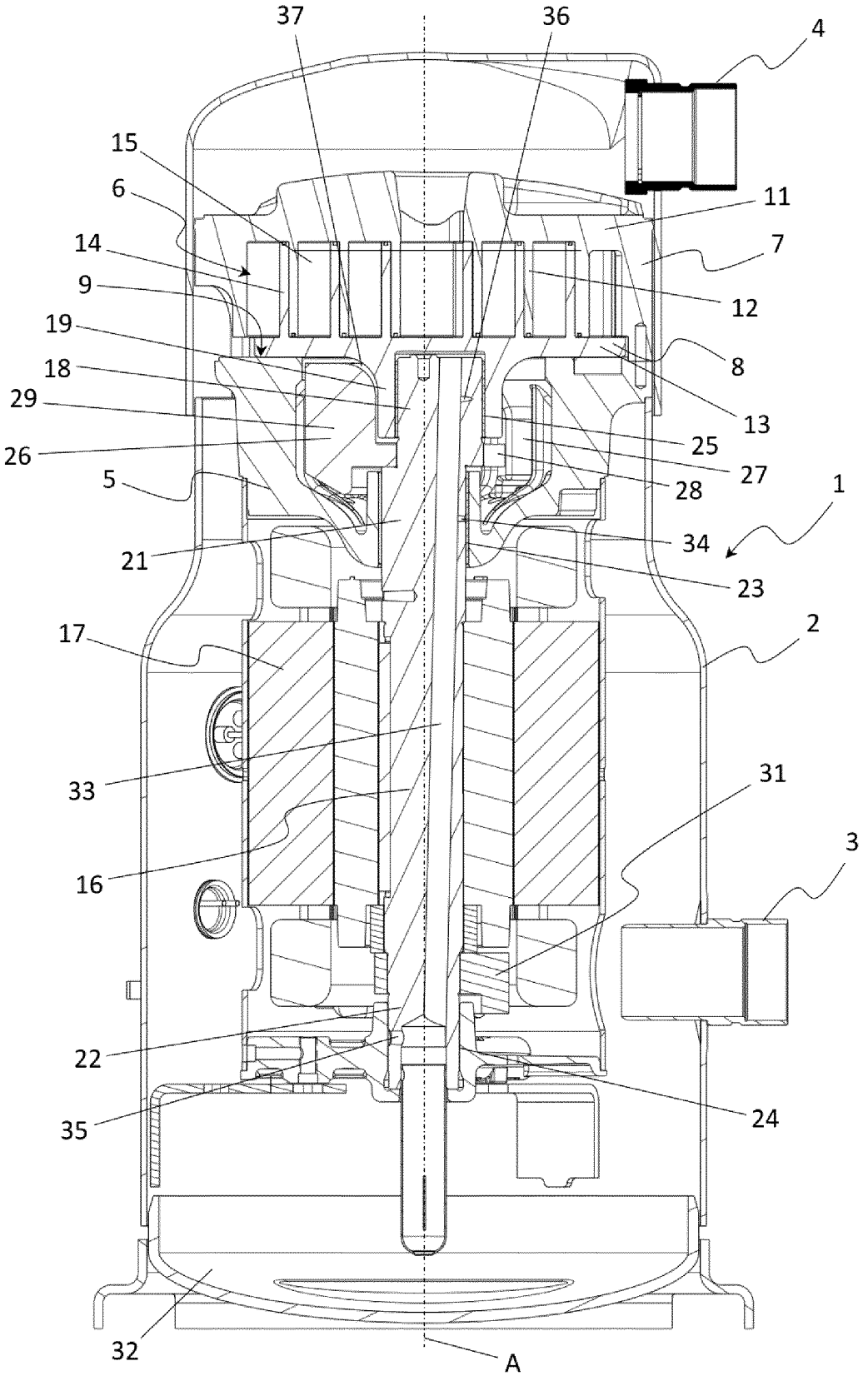

[Fig 2]
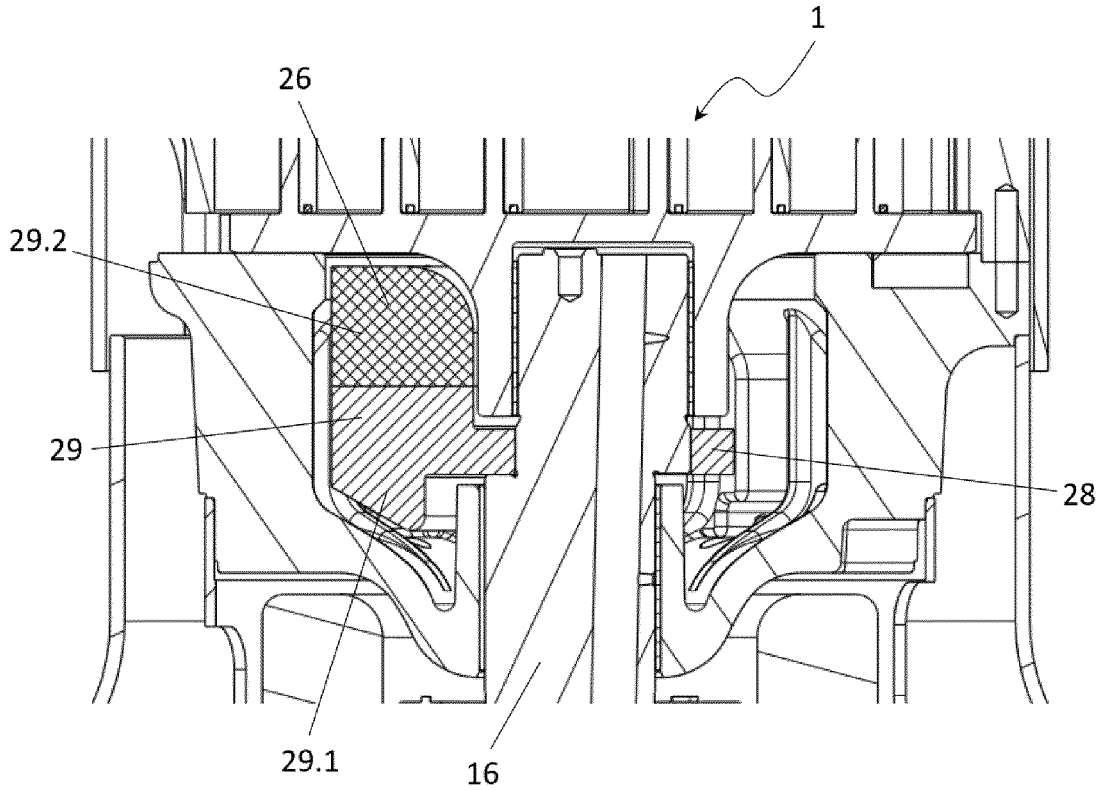
[Fig 3]
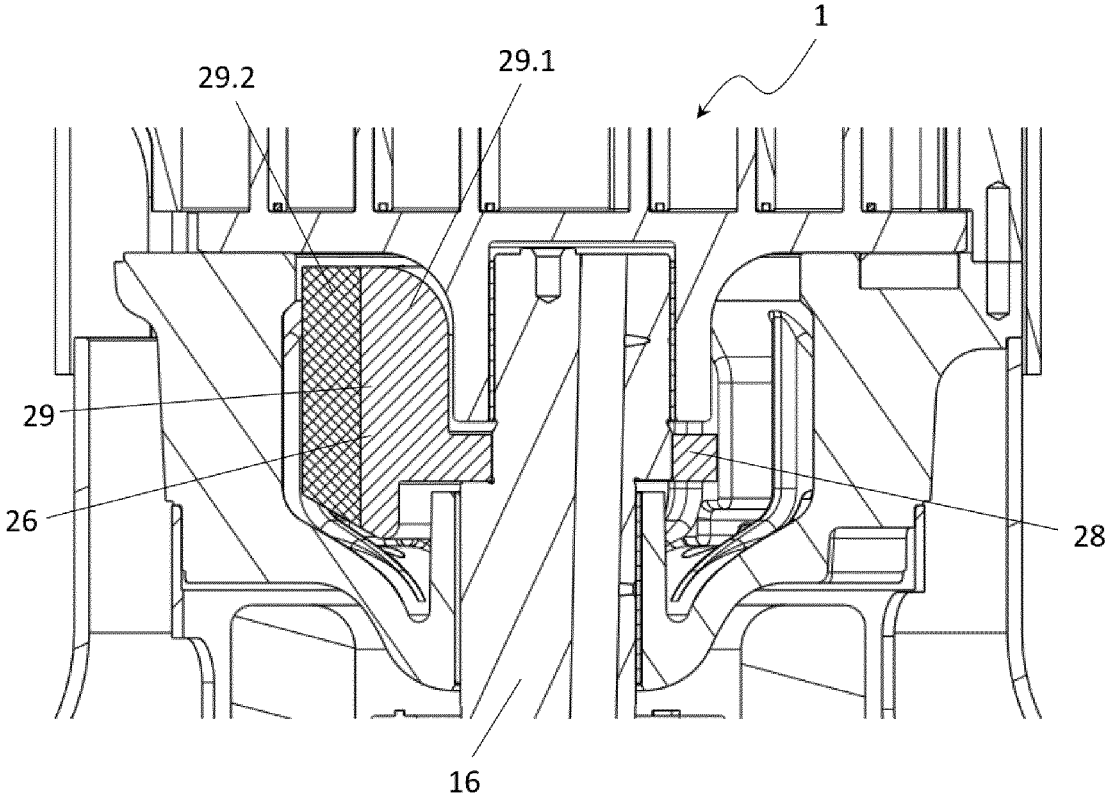

[Fig 4]
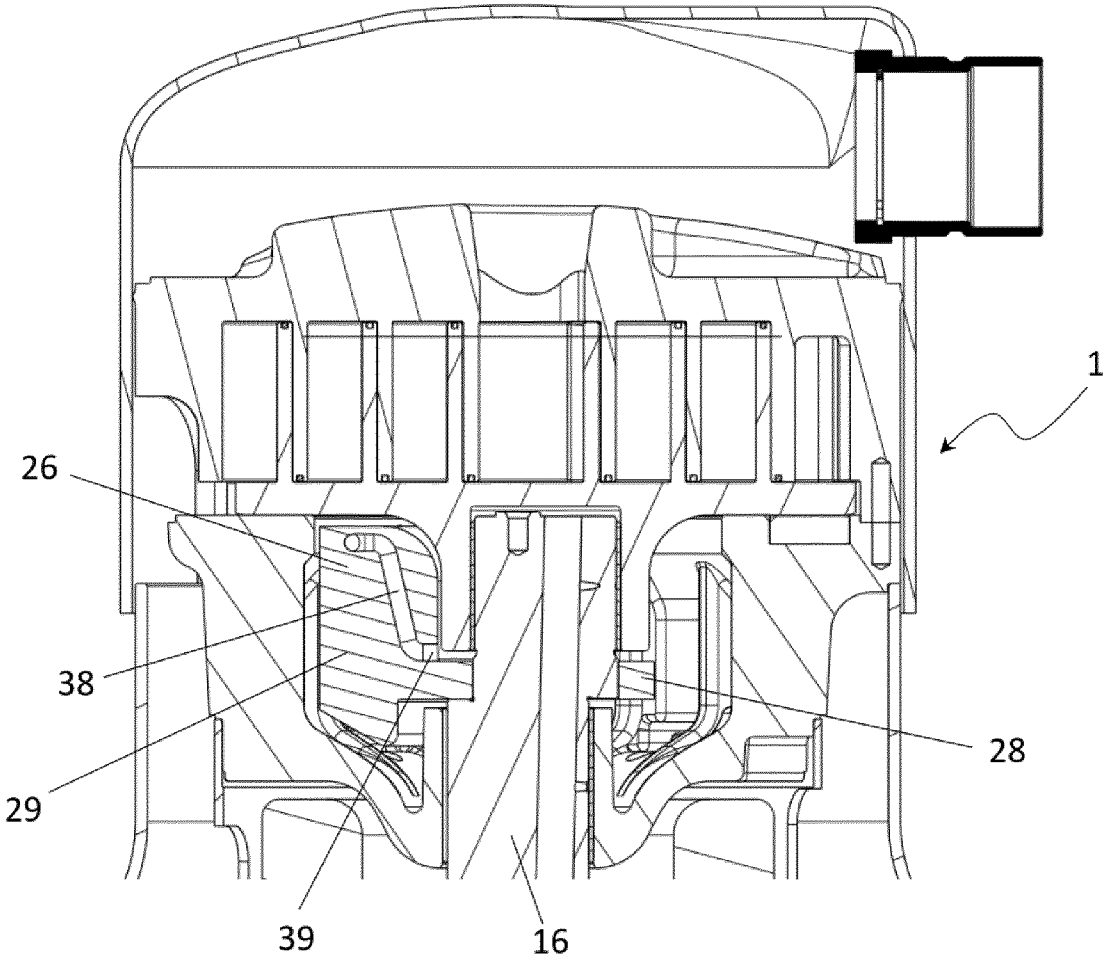
[Fig 5]
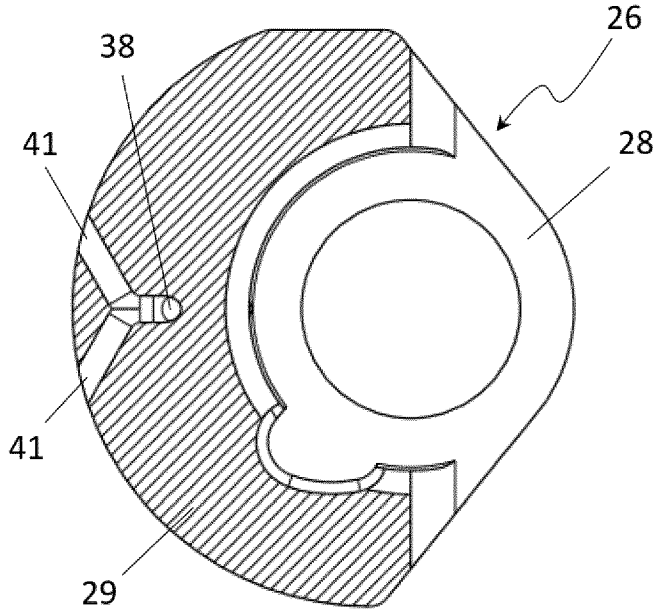

[Fig 6]
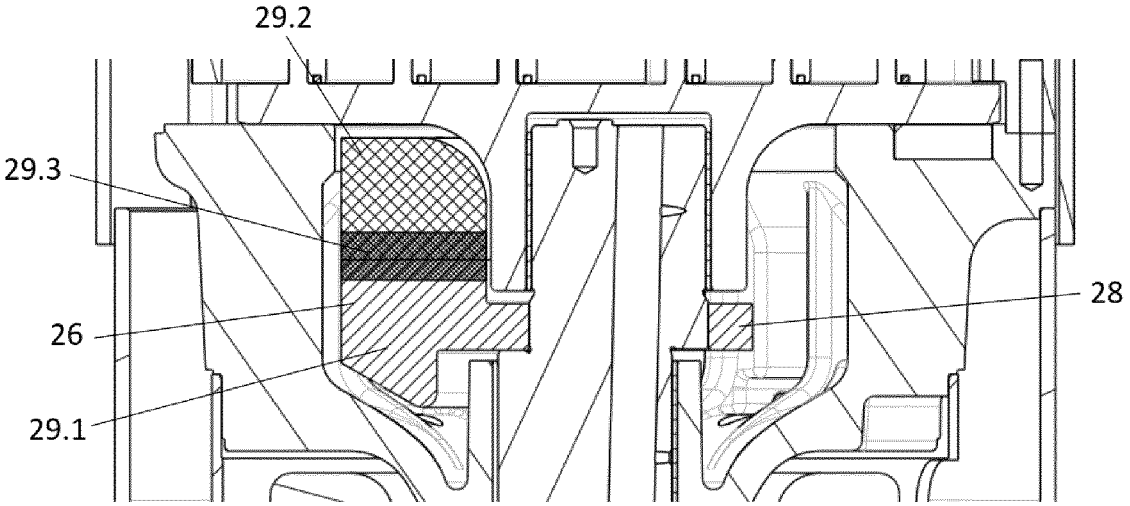
[Fig 7]
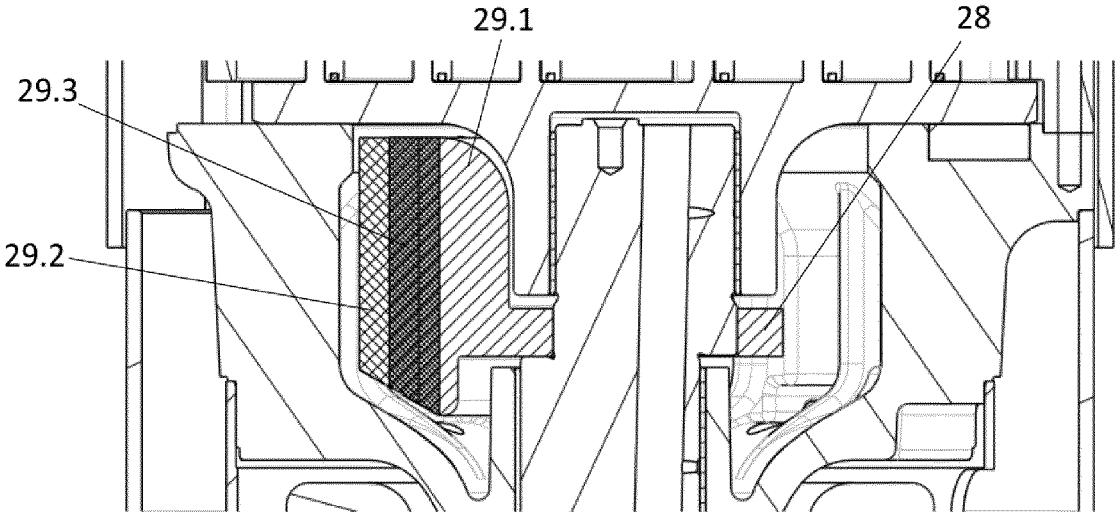
[Fig 8]
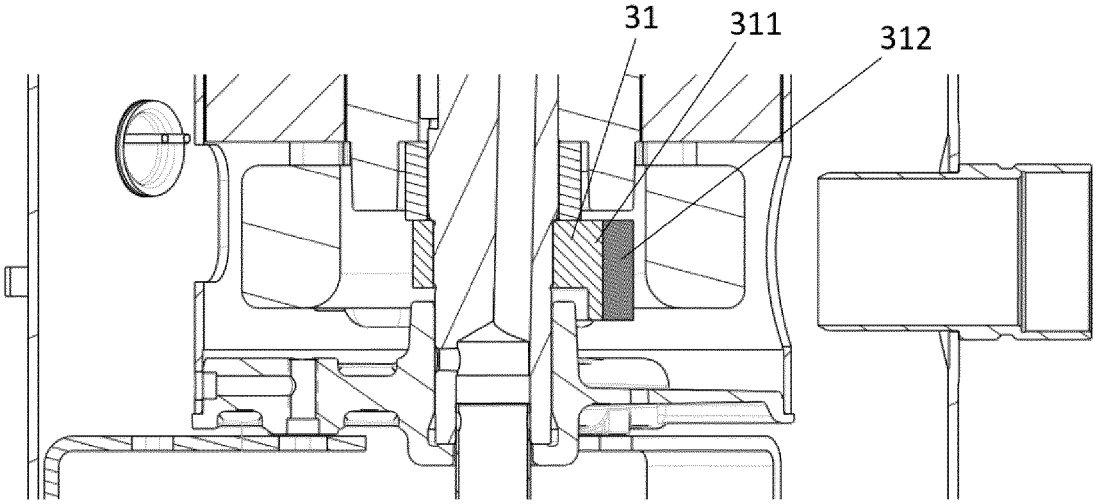

COUNTERWEIGHT FOR A SCROLL COMPRESSOR

CROSS-REFERENCE TO RELATED APPLICATIONS

This application is a National Stage application of International Patent Application No. PCT/EP2021/082832, filed on Nov. 24, 2021, which claims priority to French Patent Application No. 2012120, filed on Nov. 25, 2020, each of which is hereby incorporated by reference in its entirety.

TECHNICAL FIELD

The invention relates to a counterweight for a scroll compressor and being manufactured by 3D printing, i.e. by Additive Manufacturing.

BACKGROUND

Counterweights are commonly used in scroll compressors for dynamically balancing by minimizing loads occurring in the radial bearings of a rotating compressor drive shaft. Such loads originate from inertia and gas forces caused by the orbiting and eccentric movement of an orbiting scroll in relation to a fixed scroll. Typically, an upper counterweight arranged close to the orbiting scroll and an upper main bearing, and a lower counterweight arranged close to a lower bearing are used for the balancing task.

Different compressor sizes (and hence different scroll compression elements) require different counterweights having different sizes, shapes and/or masses. However, it is desired to use the same outer geometry of counterweights for as many different models of scroll compressors as possible. This is for cost reasons, as different sizes and shapes of counterweights would require different tools for mounting and securing the counterweights to the compressor drive shaft, as well as different handling, transport and storing equipment.

Further, different outlines of counterweights require design changes within the compressor housing to geometrically adapt other components for proper compressor operation.

U.S. Pat. No. 7,390,179 B2 discloses counterweights for scroll compressors, where cavities of different shapes and volumes are provided on the counterweights to change the total mass of the counterweights while keeping the overall outline.

Other prior art compressors may use a common molded or casted raw counterweight item, which afterwards is adapted to the different models by machining and selectively removing material.

Such individual shaping or machining of a counterweight is relatively expensive.

SUMMARY

It is an object of the present invention to provide a counterweight for a scroll compressor which can overcome the drawbacks encountered in conventional counterweights.

Another object of the present invention is to provide a counterweight for a scroll compressor whose mass can be easily adapted at lower costs, while keeping common outer dimensions for the counterweight so as to keep the same counterweight outer geometry for as many different models of scroll compressors as possible.

According to the invention such a counterweight is manufactured by an additive manufacturing process and comprises a mounting portion having a first density and a mass portion having a second density, the mass portion being formed radially outward of the mounting portion, wherein the first density of the mounting portion and the second density of the mass portion are different from each other, and wherein the mass portion comprises at least a first segment having a first segment density and a second segment having a second segment density which is different from the first segment density.

Such a configuration of the counterweight allows easily adapting the mass of the counterweight and the position of the center-of-gravity of the counterweight by varying the material density of various parts of the counterweight, and particularly by varying the infill of said various parts, while keeping common outer dimensions for the counterweight.

Further, by keeping the same counterweight outer geometry for different models of scroll compressors, it is possible use the same tool for mounting and securing each of said counterweights to the respective drive shaft and to use the same packaging for various models of counterweights, which allows saving cost.

In addition, manufacturing the counterweight by additive manufacturing process allows to obtain a more precise counterweight, which allows to master noise and vibrations generated within the scroll compressor.

Further, the fact that the first density of the mounting portion and the second density of the mass portion are different from each other allows optimization of properties of the counterweight, firstly for mounting and securing the counterweight to the drive shaft, and secondly for defining both the total mass and the center-of-gravity position of the mass portion.

The counterweight may also include one or more of the following features, taken alone or in combination.

According to an embodiment of the invention, the mounting portion is configured to be secured to a drive shaft of the scroll compressor.

According to an embodiment of the invention, the mounting portion is configured to at least partially surround the drive shaft, and for example to surround the drive shaft.

According to an embodiment of the invention, the mounting portion comprises a circular ring section.

According to an embodiment of the invention, the mounting portion has a first height, i.e. a first axial dimension, and the mass portion has a second height, i.e. a second axial dimension, which is greater than the first height, i.e. the first axial dimension.

According to an embodiment of the invention, the mounting portion and the mass portion are made of a same additive manufacturing material.

According to an embodiment of the invention, an infill ratio of the mounting portion is different from an infill ratio of the mass portion.

An infill ratio of a counterweight portion is defined as the ratio between the volume of additive manufacturing material applied to manufacture said counterweight portion and the total volume of said counterweight portion. As higher the infill ratio of a counterweight portion, as higher is the mass of said counterweight portion.

According to an embodiment of the invention, the first and second densities are determined by the amount of material used in each of the mounting portion and the mass portion, characterized by its infill ratio.

According to an embodiment of the invention, the first density of the mounting portion and the second density of the mass portion are identical, which means that a constant infill ratio has been used to manufacture the mounting portion and the mass portion.

According to an embodiment of the invention, a constant infill ratio is used to manufacture the entire counterweight.

According to an embodiment of the invention, the second density of the mass portion varies continuously. Therefore, the mass portion is devoid of distinct segments.

According to an embodiment of the invention, the first and second segments are arranged at different positions in an axial and/or radial direction.

According to an embodiment of the invention, the first and second segments differ in size.

According to an embodiment of the invention, the first segment density is identical to the first density.

According to an embodiment of the invention, the first segment is formed radially outward of the mounting portion.

According to an embodiment of the invention, the first segment is directly connected to the mounting portion.

According to an embodiment of the invention, the first segment extends radially outward from the mounting portion.

According to an embodiment of the invention, the second segment is formed radially outward of the first segment.

According to an embodiment of the invention, the first and second segments have substantially the same height, i.e. substantially the same axial dimension.

According to an embodiment of the invention, the first and second segments have substantially the same radial dimension.

According to an embodiment of the invention, the second segment is axially offset from the mounting portion.

According to an embodiment of the invention, the second segment is formed above the first segment.

According to an embodiment of the invention, the mass portion includes at least one additional segment. The segment density of the at least one additional segment may be identical to or different from the first and second segment densities.

According to an embodiment of the invention, the first and second segments and the at least one additional segment are arranged in any order of position or size within the mass portion.

According to an embodiment of the invention, the segment densities of all segments of the mass portion are different from the first density of the mounting portion.

According to an embodiment of the invention, the counterweight includes an oil passage formed within the mass portion.

According to an embodiment of the invention, the oil passage includes at least one oil outlet aperture emerging in an outer surface of the mass portion.

According to the embodiment of the invention, the at least one oil outlet aperture includes several oil outlet apertures which are angularly offset with respect to a central axis of the mounting portion.

According to an embodiment of the invention, the oil passage includes an oil inlet aperture emerging in the inner surface of the mass portion. Advantageously, the oil inlet aperture is located near the mounting portion.

According to an embodiment of the invention, the at least one oil outlet aperture is axially offset from the oil inlet aperture.

According to an embodiment of the invention, the at least one oil outlet aperture is located near an end surface of the mass portion. Advantageously, the end surface is configured to face an orbiting scroll of the scroll compressor.

The present invention also relates to a scroll compressor including a drive shaft and at least one counterweight according to the present invention secured to the drive shaft.

According to an embodiment of the invention, the drive shaft extends substantially vertically and the at least one counterweight includes a first counterweight secured to an upper part of the drive shaft and a second counterweight secured to a lower part of the drive shaft.

According to an embodiment of the invention, the first counterweight is configured to at least partially balance the mass of an orbiting scroll of the scroll compressor.

According to an embodiment of the invention, the first counterweight is secured to a driving portion of the drive shaft which is partially mounted in a hub portion provided on the orbiting scroll and which is configured to cooperate with the hub portion so as to drive the orbiting scroll in orbital movements.

These and other advantages will become apparent upon reading the following description in view of the drawing attached hereto representing, as non-limiting examples, embodiments of a scroll compressor according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

FIG. 1 is a longitudinal section view of a scroll compressor according to a first embodiment of the invention.

FIG. 2 is a partial longitudinal section view of a scroll compressor according to a second embodiment of the invention.

FIG. 3 is a partial longitudinal section view of a scroll compressor according to a third embodiment of the invention.

FIG. 4 is a partial longitudinal section view of a scroll compressor according to a fourth embodiment of the invention.

FIG. 5 is a cross section view of a first counterweight of the scroll compressor of FIG. 4.

FIG. 6 is a partial longitudinal section view of a scroll compressor according to a fifth embodiment of the invention.

FIG. 7 is a partial longitudinal section view of a scroll compressor according to a sixth embodiment of the invention.

FIG. 8 is a partial longitudinal section view of a scroll compressor according to a seventh embodiment of the invention.

DETAILED DESCRIPTION

FIG. 1 describes a scroll compressor 1 according to a first embodiment of the invention occupying a vertical position.

The scroll compressor 1 includes a hermetic casing 2 provided with a suction inlet 3 configured to supply the scroll compressor 1 with refrigerant to be compressed, and with a discharge outlet 4 configured to discharge compressed refrigerant.

The scroll compressor 1 further includes a support arrangement 5 fixed to the hermetic casing 2, and a compression unit 6 disposed inside the hermetic casing 2 and supported by the support arrangement 5. The compression unit 6 is configured to compress the refrigerant supplied by the suction inlet 3. The compression unit 6 includes a fixed scroll 7, which is fixed in relation to the hermetic casing 2, and an orbiting scroll 8 supported by and in slidable contact with a thrust bearing surface 9 provided on the support arrangement 5.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

Furthermore, the scroll compressor 1 includes a drive shaft 16 which extends vertically and which is configured to drive the orbiting scroll 8 in an orbital movement, and an electric driving motor 17, which may be for example a variable-speed electric driving motor, coupled to the drive shaft 16 and configured to drive in rotation the drive shaft 16 about a rotation axis A.

The drive shaft 16 includes, at its upper end, a driving portion 18 which is offset from the longitudinal axis of the drive shaft 16, and which is partially mounted in a hub portion 19 provided on the orbiting scroll 8. The driving portion 18 is configured to cooperate with the hub portion 19 so as to drive the orbiting scroll 8 in orbital movements relative to the fixed scroll 7 when the electric driving motor 17 is operated.

The drive shaft 16 also includes an upper guided portion 21 adjacent to the driving portion 18 and a lower guided portion 22 opposite to the first guided portion 21, and the scroll compressor 1 further includes an upper main bearing 23 provided on the support arrangement 5 and configured to guide in rotation the upper guided portion 21 of the drive shaft 16, and a lower main bearing 24 configured to guide in rotation the lower guided portion 22 of the drive shaft 16. The scroll compressor 1 also includes an orbiting scroll hub bearing 25 provided on the orbiting scroll 8 and arranged for cooperating with the driving portion 18 of the drive shaft 16.

Furthermore, the scroll compressor 1 includes a first counterweight 26 secured to the driving portion 18 and configured to at least partially balance the mass of the orbiting scroll 8. Particularly, the support arrangement 5 defines a receiving chamber 27 located above the upper main bearing 23 and in which the hub portion 19, the driving portion 18 and the first counterweight 26 are movably disposed.

The first counterweight 26 comprises a mounting portion 28 which is secured to the drive shaft 16 and which surrounds the drive shaft 16. Advantageously, the mounting portion 28 has a circular ring section.

The first counterweight 26 further comprises a mass portion 29 which is formed radially outward of the mounting portion 28. Advantageously, the mounting portion 28 has a first height, i.e. a first axial dimension, and the mass portion 29 has a second height, i.e. a second axial dimension, which is greater than the first height, i.e. the first axial dimension.

The first counterweight 26 is manufactured by an additive manufacturing process, and the mounting portion 28 and the mass portion 29 are advantageously made of a same additive manufacturing material.

According to the first embodiment shown on FIG. 1, the mounting portion 28 has a first density, and the mass portion 29 has a second density which is identical to the first density, which means that an infill ratio of the mounting portion 28 is identical to an infill ratio of the mass portion 29.

According to another embodiment of the invention, the second density of the mass portion 29 may be different from the first density of the mounting portion 28, and the infill ratio of the mounting portion 28 may be different from the infill ratio of the mass portion 29. This allows optimization of properties of the first counterweight 26, firstly for mounting and securing the first counterweight 26 to the drive shaft, and secondly for defining both the total mass and the center-of-gravity position of the mass portion 29 of the first counterweight 26.

The scroll compressor 1 also includes a second counterweight 31 secured to a lower part of the drive shaft 16 and located near the lower main bearing 24. Advantageously, the second counterweight 31 is also manufactured by an additive manufacturing process, and includes, as the first counterweight 26, a mounting portion secured to the drive shaft 16 and a mass portion formed radially outward of the respective mounting portion. The mounting portion and the mass portion of the second counterweight 31 may be made of a same additive manufacturing material. A density of the mass portion of the second counterweight 31 may for example be identical to or different from a density of the mounting portion of the second counterweight 31.

Moreover, the scroll compressor 1 also includes a lubrication system configured to lubricate at least partially the thrust bearing surface 9, the upper main bearing 23, the lower main bearing 24 and the orbiting scroll hub bearing 25 with oil supplied from an oil sump 32 defined by the hermetic casing 2, and particularly located at the bottom of the hermetic casing 2.

The lubrication system includes an oil supplying channel 33 formed within the drive shaft 16 and extending over the whole length of the drive shaft 16. The oil supplying channel 33 is configured to be supplied with oil from the oil sump 32. According to the embodiment shown on FIG. 1, the oil supplying channel 33 emerges in an end face of the drive shaft 16 oriented towards the orbiting scroll 8.

The lubrication system may further include an oil feeding passage provided on the driving portion 18 of the drive shaft 16 and fluidly connected to the oil supplying channel 33. The oil feeding passage may include a first end emerging in the end face of the drive shaft 16 and a second end emerging in an outer wall of the driving portion 18 facing the first counterweight 26 in the area of the lower end of hub portion 19.

According to the embodiment shown on FIG. 1, the lubrication system further includes:

- a first lubrication hole 34 provided on the drive shaft 16 and fluidly connected to the oil supplying channel 33, the first lubrication hole 34 emerging in an outer wall of the upper guided portion 21 of the drive shaft 16 and facing the upper main bearing 23,
- a second lubrication hole 35 provided on the drive shaft 16 and fluidly connected to the oil supplying channel 33, the second lubrication hole 35 emerging in an outer wall of the lower guided portion 22 of the drive shaft 16 and facing the lower main bearing 24, and a third lubrication hole 36 provided on the drive shaft 16 and fluidly connected to the oil supplying channel 33, the third lubrication hole 36 emerging in an outer wall of the driving portion 18 of the drive shaft 16 and facing the orbiting scroll hub bearing 25.

When the electric driving motor 17 is operated and the drive shaft 16 rotates about its rotation axis A, oil from the oil sump 32 climbs into the oil supplying channel 33 of the drive shaft 16 due to centrifugal effect, and reaches the end face of the drive shaft 16 after lubricating the lower main bearing 24, the upper main bearing 23, and the orbiting scroll hub bearing 25. At least a part of the oil having reached the end face of the drive shaft 16 is evacuated towards an oil supplying passage 37, defined by the first counterweight 26 and the orbiting scroll 8, via the oil feeding passage provided on the driving portion 18 and/or via the orbiting scroll hub bearing 25. Then, due to centrifugal effect, oil flows in the oil supplying passage 37 and is directed towards the thrust bearing surface 9.

FIG. 2 represents a scroll compressor 1 according to a second embodiment of the invention which differs from the first embodiment essentially in that the mass portion 29 of the first counterweight 26 comprises a first segment 29.1 having a first segment density and a second segment 29.2 having a second segment density, and in that the first and second segments 29.1, 29.2 are arranged at different positions in an axial direction.

According to said second embodiment of the invention, the first segment density is identical to the first density, and the second segment density is different from the first segment density. However, the second segment density may be identical to the first segment density. In addition, the first and second segment densities may also be different from to the first density of the mounting portion 28.

According to the second embodiment of the invention, the first segment 29.1 is directly connected to the mounting portion 28 and is formed radially outward of the mounting portion 28, and the second segment 29.2 is formed above the first segment 29.1 and is axially offset from the mounting portion 28. Advantageously, the first and second segments 29.1, 29.2 have substantially the same radial dimension.

FIG. 3 represents a scroll compressor 1 according to a third embodiment of the invention which differs from the second embodiment essentially in that the first and second segments 29.1, 29.2 are arranged at different positions in a radial direction, and particularly in that the second segment 29.2 is formed radially outward of the first segment 29.1.

According to said third embodiment of the invention, the first and second segments 29.1, 29.2 have substantially the same height, i.e. substantially the same axial dimension.

FIGS. 4 and 5 represent a scroll compressor 1 according to a fourth embodiment of the invention which differs from the first embodiment essentially in that the first counterweight 26 includes an oil passage 38 formed within the mass portion 29 and forming part of the lubrication system.

The oil passage 38 includes an oil inlet aperture 39 which emerges in an inner surface of the mass portion 29 and which is located near the mounting portion 28. The oil inlet aperture 39 is fluidly connected to the oil supplying channel 33 for example via the oil feeding passage provided on the driving portion 18. The oil passage 38 further includes several oil outlet apertures 41, for example two, which emerge in an outer surface of the mass portion 29 and which are angularly offset with respect to a central axis of the mounting portion 28.

The oil passage 38 may include a main passage part which is fluidly connected to the oil inlet aperture 39 and which is inclined with respect to the rotation axis A, and bypass parts which are fluidly connected to the main passage part and which each include a respective oil outlet aperture 41.

Advantageously, the oil outlet apertures 41 are axially offset from the oil inlet aperture 39 and are located near an end surface of the mass portion 29 configured to face the orbiting scroll 8 of the scroll compressor 1.

According to another embodiment of the invention, the oil passage 38 may include only one oil outlet aperture 41.

FIG. 6 represents a scroll compressor 1 according to a fifth embodiment of the invention which differs from the second embodiment essentially in that the mass portion 29 of the first counterweight 26 further comprises an additional segment 29.3 having a segment density which is different from the first and second segment densities, and in that the additional segment 29.3 is arranged between the first and second segments 29.1, 29.2.

FIG. 7 represents a scroll compressor 1 according to a sixth embodiment of the invention which differs from the fifth embodiment essentially in that the first and second segments 29.1, 29.2 and the additional segment 29.3 are arranged at different positions in a radial direction, and particularly in that the additional segment 29.3 is formed radially outward of the first segment 29.1 and the second segment 29.2 is formed radially outward of the additional segment 29.3.

FIG. 8 represents a scroll compressor 1 according to a seventh embodiment of the invention which differs from the first embodiment essentially in that the mass portion of the second counterweight 31 comprises a primary segment 311 having a primary segment density and a secondary segment 312 having a secondary segment density, and in that the primary and secondary segments 311, 312 are arranged at different positions in a radial direction. Particularly, the secondary segment 312 is formed radially outward of the primary segment 311.

According to another embodiment of the invention, the primary and secondary segments 311, 312 may be arranged at different positions in an axial direction.

According to another embodiment of the invention, the mass portion of the second counterweight 31 may comprise more than two segments.

Of course, the invention is not restricted to the embodiments described above by way of non-limiting examples, but on the contrary it encompasses all embodiments thereof.

What is claimed is:

1. A counterweight for a scroll compressor, the counterweight being manufactured by an additive manufacturing process and comprising a mounting portion having a first density and a mass portion having a second density, the mass portion being formed radially outward of the mounting portion, wherein the first density of the mounting portion and the second density of the mass portion are different from each other, wherein the mass portion comprises at least a first segment having a first segment density and a second segment having a second segment density which is different from the first segment density, wherein the counterweight is 3D printed, and wherein a 3D printed infill ratio of the mounting portion is different from a 3D printed infill ratio of the mass portion.

2. The counterweight according to claim 1, wherein the mounting portion is configured to be secured to a drive shaft of the scroll compressor.

3. The counterweight according to claim 2, wherein the mounting portion is configured to at least partially surround the drive shaft.

4. The counterweight according to claim 1, wherein the mounting portion comprises a circular ring section.

5. The counterweight according to claim 1, wherein the mounting portion and the mass portion are made of a same additive manufacturing material.

6. The counterweight according to claim 5, wherein the first segment density is identical to the first density.

7. The counterweight according to claim 1, wherein the first and second segments are arranged at different positions in an axial direction and/or are arranged at different positions in a radial direction.

8. The counterweight according to claim 7, wherein the first and second segments differ in size.

9. The counterweight according to claim 7, wherein the first segment density is identical to the first density.

10. The counterweight according to claim 1, wherein the first and second segments differ in size.

11. The counterweight according to claim 1, wherein the first segment density is identical to the first density.

12. The counterweight according to claim 1, wherein the mass portion includes at least one additional segment, a segment density of the at least one additional segment being identical to or different from the first and second segment densities.

13. The counterweight according to claim 12, wherein the first and second segments and the at least one additional segment are arranged in any order of position or size within the mass portion.

14. The counterweight according to claim 1, wherein the counterweight includes an oil passage formed within the mass portion.

15. The counterweight according to claim 14, wherein the oil passage includes at least one oil outlet aperture emerging in an outer surface of the mass portion.

16. The counterweight according to claim 15, wherein the at least one oil outlet aperture includes several oil outlet apertures which are angularly offset with respect to a central axis of the mounting portion.

17. A scroll compressor including a drive shaft and at least one counterweight according to claim 1 secured to the drive shaft.

18. The scroll compressor according to claim 17, wherein the drive shaft extends substantially vertically and the at least one counterweight includes a first counterweight secured to an upper part of the drive shaft and a second counterweight secured to a lower part of the drive shaft.

19. The counterweight according to claim 1, wherein the second density of the mass portion varies continuously.

20. A counterweight for a scroll compressor, the counterweight being manufactured by an additive manufacturing process and comprising a mounting portion having a first density and a mass portion having a second density, the mass portion being formed radially outward of the mounting portion, wherein the first density of the mounting portion and the second density of the mass portion are different from each other, wherein the mass portion comprises at least a first segment having a first segment density and a second segment having a second segment density which is different from the first segment density, wherein the counterweight is 3D printed, and wherein the counterweight includes an oil passage formed within the mass portion.

21. A counterweight for a scroll compressor, the counterweight being manufactured by an additive manufacturing process and comprising a mounting portion having a first density and a mass portion having a second density, the mass portion being formed radially outward of the mounting portion, wherein the first density of the mounting portion and the second density of the mass portion are different from each other, wherein the mass portion comprises at least a first segment having a first segment density and a second segment having a second segment density which is different from the first segment density, wherein the counterweight is 3D printed, and wherein the counterweight includes an oil passage having inlet and outlet apertures that are radially offset from each other.

* * * * *